US008881702B1

(12) United States Patent
Lichti et al.

(10) Patent No.: US 8,881,702 B1
(45) Date of Patent: Nov. 11, 2014

(54) CAMSHAFT PHASER

(71) Applicant: Delphi Technologies, Inc., Troy, MI (US)

(72) Inventors: Thomas H. Lichti, Victor, NY (US); Cai P. Shum, Mendon, NY (US); Paul A. Armour, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/972,403

(22) Filed: Aug. 21, 2013

(51) Int. Cl.
*F01L 1/34* (2006.01)
*F01L 1/344* (2006.01)

(52) U.S. Cl.
CPC ..... *F01L 1/3442* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS

| | | | | |
|---|---|---|---|---|
| 6,263,843 | B1 | 7/2001 | Todo et al. | |
| 7,363,897 | B2 | 4/2008 | Fischer et al. | |
| 7,614,370 | B2 * | 11/2009 | Fischer et al. | 123/90.15 |
| 8,056,519 | B2 | 11/2011 | Cuatt et al. | |
| 8,127,728 | B2 | 3/2012 | Fischer et al. | |
| 2010/0288215 | A1 | 11/2010 | Takemura et al. | |
| 2012/0255509 | A1 | 10/2012 | Lichti et al. | |

* cited by examiner

*Primary Examiner* — Ching Chang
(74) *Attorney, Agent, or Firm* — Thomas N. Twomey

(57) ABSTRACT

A camshaft phaser is provided for varying the phase relationship between a crankshaft and a camshaft in an engine. The camshaft phaser includes a stator having lobes. A rotor disposed within the stator and rotatable between a full retard position to a full retard position includes vanes interspersed with the stator lobes to define alternating advance and retard chambers. A lock pin selectively engages a lock pin seat for preventing a change in phase relationship between the rotor and the stator at a predetermined aligned position between the full advance and full retard positions. A counterbalancing member is located within one of the advance chambers or the retard chambers, attached to a vane to thereby apply a torque between the rotor and the stator only when the rotor is between the predetermined aligned position and one of the full retard position and the full advance position.

15 Claims, 5 Drawing Sheets

CAMSHAFT PHASER

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser; even more particularly to a vane-type camshaft phaser which includes a bias spring for biasing a rotor relative to a stator; and still even more particularly to a vane-type camshaft phaser with a counterbalancing member which neutralizes the bias spring for a portion of the travel of the rotor.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers in order to rotate the rotor within the stator and thereby change the phase relationship between an engine camshaft and an engine crankshaft. Camshaft phasers also commonly include an intermediate lock pin which selectively prevents relative rotation between the rotor and the stator at an angular position that is intermediate of a full advance and a full retard position. The intermediate lock pin is engaged and disengaged by venting oil from the intermediate lock pin and supplying pressurized oil to the intermediate lock pin respectively.

Some camshaft phasers utilize a bias spring to apply a torque to the rotor in order to urge the rotor to rotate, typically in the advance direction of rotation, to either partially or completely offset the natural retarding torque induced by the overall valve train friction to balance performance times, or to help return the phaser to a default position. The bias spring typically applies a torque to the rotor for the entire range of motion of the rotor 18 within the stator, i.e. between the full retard position and the full advance position, and in the direction toward the full advance position. However, the torque of the bias spring applied to the rotor may make engagement of the intermediate lock pin difficult.

U.S. Pat. No. 7,363,897 to Fischer et al. (Fisher '897) teaches an arrangement to aid in engaging the intermediate lock pin. In this arrangement, the bias spring urges the rotor toward the predetermined aligned position from any position retarded of the predetermined aligned position but does not engage the rotor from any position advanced of the predetermined aligned position. While this arrangement may be effective, the arrangement may increase the axial length of the camshaft phaser which may be undesirable in applications where space for the camshaft phaser is limited.

U.S. Pat. No. 8,127,728 to Fisher et al. (Fisher '728) teaches another arrangement to aid in engaging the intermediate lock pin. In this arrangement, a first bias spring urges the rotor toward the predetermined aligned position from any position retarded of the predetermined aligned position and a second bias spring urges the rotor in the advance direction over the full range of rotation of the rotor. Just as with Fisher '897, the arrangement of Fisher '728 may be effective, but the arrangement may increase the axial length of the camshaft phaser which may be undesirable in applications where space for the camshaft phaser is limited.

What is needed is camshaft phaser which minimizes or eliminates one or more the shortcomings as set forth above.

SUMMARY OF THE INVENTION

Briefly described, a camshaft phaser is provided for controllably varying the phase relationship between a crankshaft and a camshaft in an internal combustion engine. The camshaft phaser includes a stator having a plurality of lobes and connectable to the crankshaft of the internal combustion engine to provide a fixed ratio of rotation between the stator and the crankshaft. The camshaft phaser also includes a rotor coaxially disposed within the stator, the rotor having a plurality of vanes interspersed with the stator lobes defining alternating advance chambers and retard chambers. The advance chambers receive pressurized oil in order to change the phase relationship between the crankshaft and the camshaft in an advance direction and the retard chambers receive pressurized oil in order to change the phase relationship between the camshaft and the crankshaft in a retard direction. The rotor is rotatable within the stator from a full retard position to a full advance and is attachable to the camshaft of the internal combustion engine to prevent relative rotation between the rotor and the camshaft. A lock pin is disposed within either the rotor or the stator for selective engagement with a lock pin seat for preventing a change in phase relationship between the rotor and the stator at a predetermined aligned position between the full advance position and the full retard position when the lock pin is engaged with the lock pin seat. A resilient counterbalancing member is located within one of the advance chambers or the retard chambers, attached to one of the plurality of vanes or one of the plurality of lobes to thereby apply a torque between the rotor or the stator only when the rotor is between the predetermined aligned position and one of the full retard position and the full advance position.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
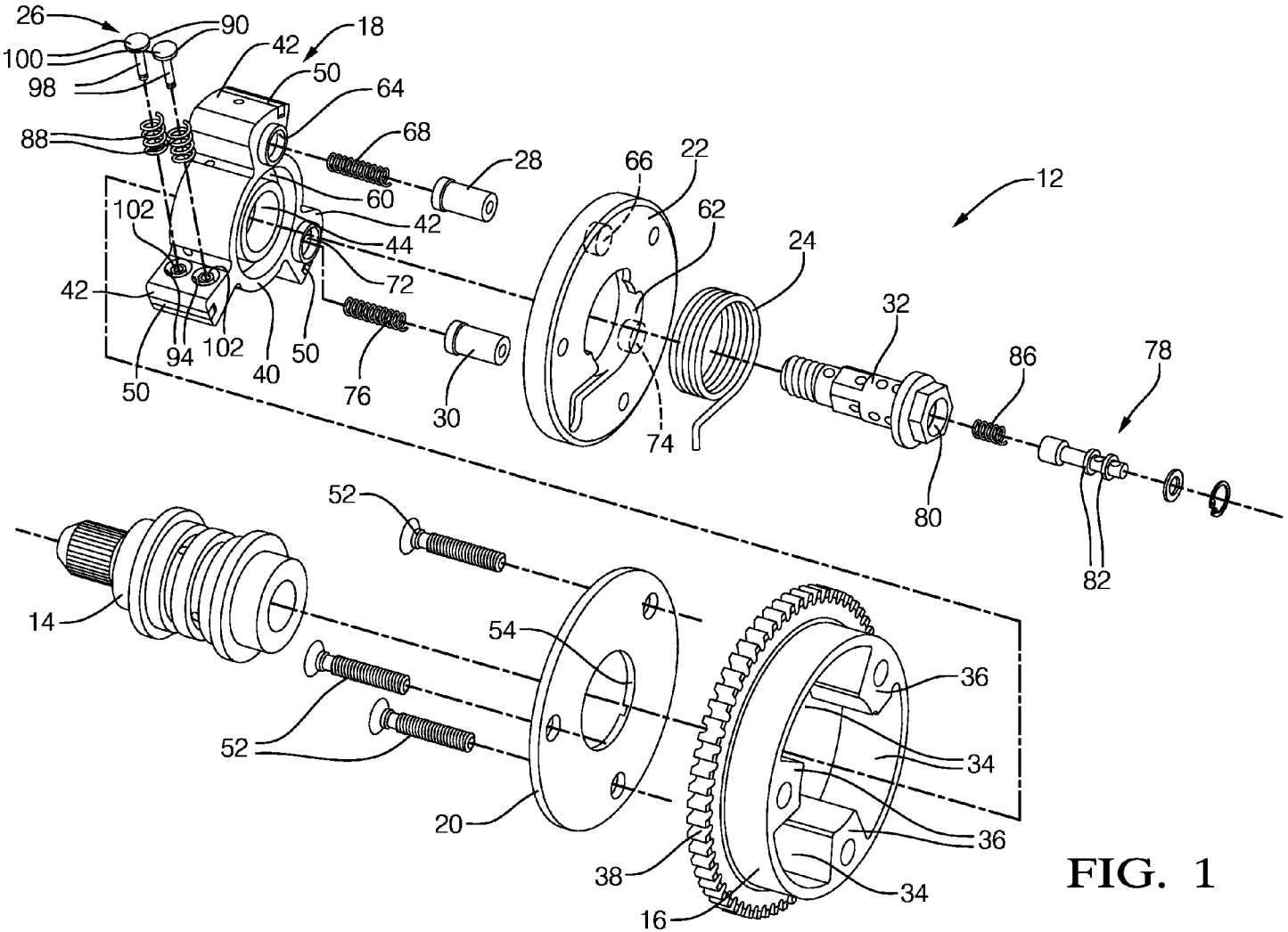
FIG. 1 is an exploded isometric view of a camshaft phaser in accordance with the present invention.
Figure 2:
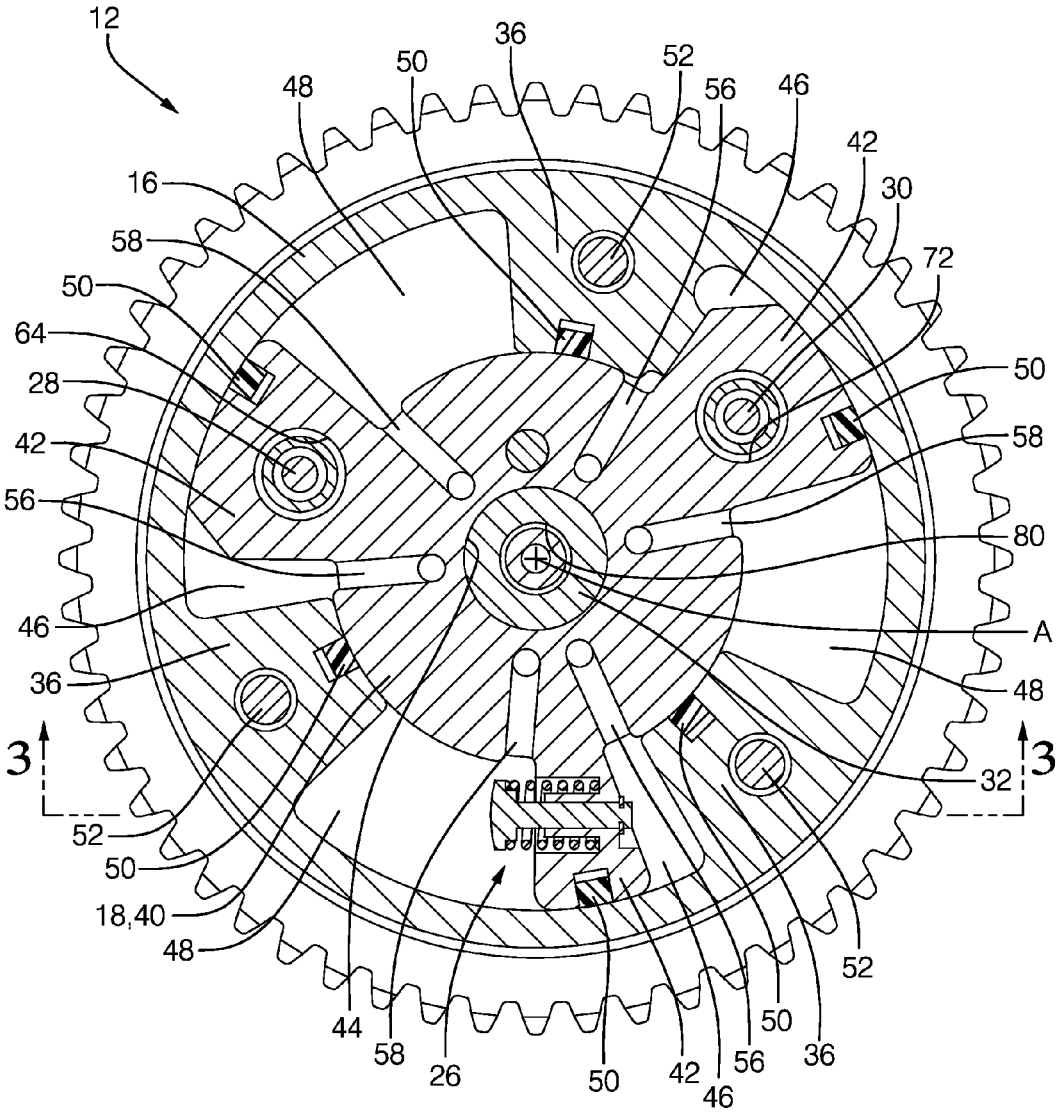
FIG. 2 is a radial cross-sectional view of the camshaft phaser in accordance with the present invention.
Figure 3:
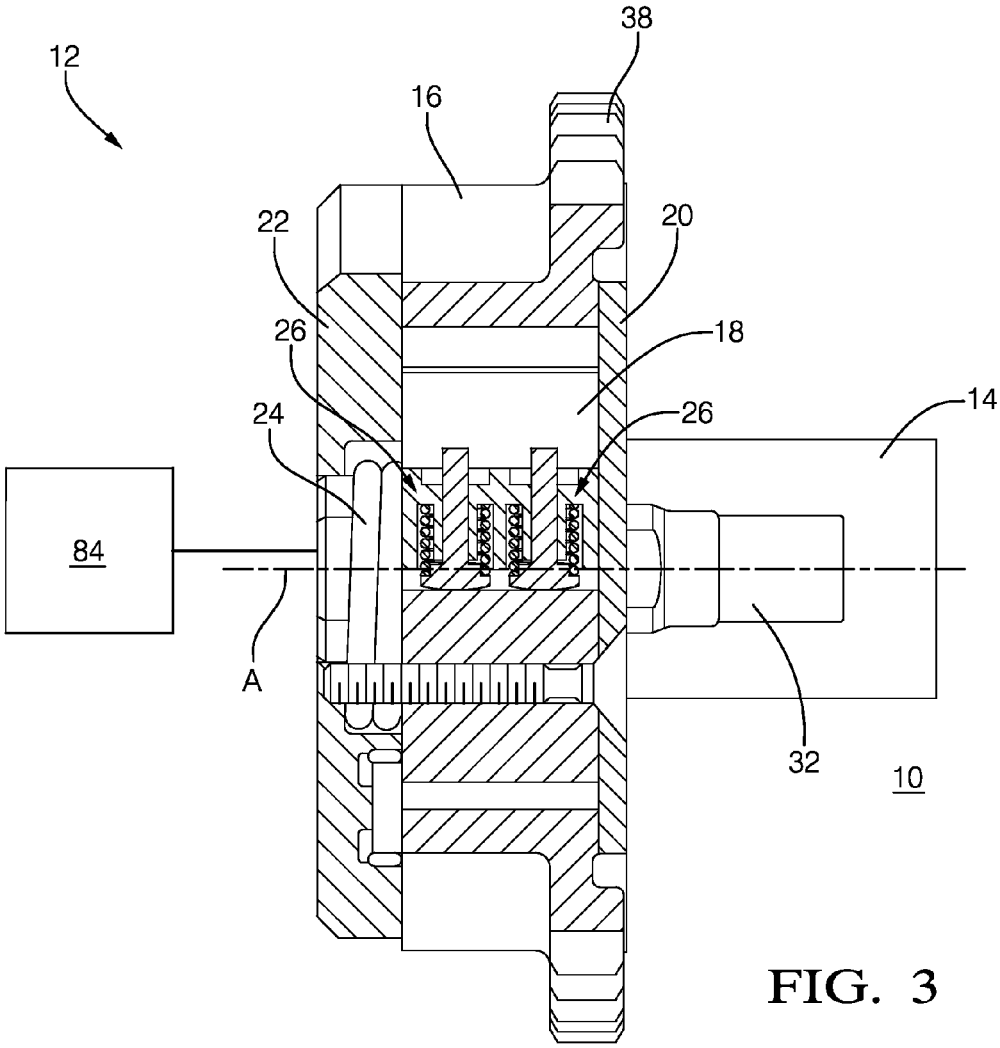
FIG. 3. is cross-sectional view of the camshaft phaser in accordance with the present invention taken through section line 3-3 of FIG. 2.

In accordance with a preferred embodiment of this invention and referring to FIGS. 1, 2, and 3, an internal combustion engine 10 is shown which includes camshaft phaser 12. Internal combustion engine 10 also includes camshaft 14 which is rotatable about an axis A based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 16, a rotor 18 disposed coaxially within stator 16, a back cover 20 closing off one end of stator 16, a front cover 22 closing off the other end of stator 16, a bias spring 24 for urging rotor 18 in one direction relative to stator 16, a pair of counterbalancing members 26 for neutralizing bias spring 24 for a portion of the range of travel of rotor 18, a primary lock pin 28, a secondary lock pin 30, and a camshaft phaser attachment bolt 32 for attaching camshaft phaser 12 to camshaft 14. The various elements of camshaft phaser 12 will be described in greater detail in the paragraphs that follow.

Stator 16 is generally cylindrical and includes a plurality of radial chambers 34 defined by a plurality of lobes 36 extending radially inward. In the embodiment shown, there are three lobes 36 defining three radial chambers 34, however, it is to be understood that a different number of lobes 36 may be provided to define radial chambers 34 equal in quantity to the number of lobes 36. Stator 16 may also include a sprocket 38 formed integrally therewith or otherwise fixed thereto. Sprocket 38 is configured to be driven by a chain or gear that is driven by the crankshaft of internal combustion engine 10. Alternatively, sprocket 38 may be a pulley driven by a belt.

Rotor 18 includes a central hub 40 with a plurality of vanes 42 extending radially outward therefrom and a central through bore 44 extending axially therethrough. The number of vanes 42 is equal to the number of radial chambers 34 provided in stator 16. Rotor 18 is coaxially disposed within stator 16 such that each vane 42 divides each radial chamber 34 into advance chambers 46 and retard chambers 48. The radial tips of lobes 36 are mateable with central hub 40 in order to separate radial chambers 34 from each other. Each of the radial tips of lobes 36 and vanes 42 may include one of a plurality of wiper seals 50 to substantially seal adjacent advance chambers 46 and retard chambers 48 from each other.

Back cover 20 is sealingly secured, using cover bolts 52, to the axial end of stator 16 that is proximal to camshaft 14. Tightening of cover bolts 52 prevents relative rotation between back cover 20 and stator 16. Back cover 20 includes a back cover central bore 54 extending coaxially therethrough. The end of camshaft 14 is received coaxially within back cover central bore 54 such that camshaft 14 is allowed to rotate relative to back cover 20. In an alternative arrangement, sprocket 38 may be integrally formed or otherwise attached to back cover 20 rather than stator 16.

Similarly, front cover 22 is sealingly secured, using cover bolts 52, to the axial end of stator 16 that is opposite back cover 20. Cover bolts 52 pass through stator 16 and threadably engage front cover 22, thereby clamping stator 16 between back cover 20 and front cover 22 to prevent relative rotation between stator 16, back cover 20, and front cover 22. In this way, advance chambers 46 and retard chambers 48 are defined axially between back cover 20 and front cover 22.

Camshaft phaser 12 is attached to camshaft 14 with camshaft phaser attachment bolt 32 which extends coaxially through central through bore 44 of rotor 18 and threadably engaging camshaft 14, thereby by clamping rotor 18 securely to camshaft 14. In this way, relative rotation between stator 16 and rotor 18 results in a change is phase or timing between the crankshaft of internal combustion engine 10 and camshaft 14.

Oil is selectively supplied to advance chambers 46 and vented from retard chambers 48 in order to cause relative rotation between stator 16 and rotor 18 which results in advancing the timing of camshaft 14 relative to the crankshaft of internal combustion engine 10. Conversely, oil is selectively supplied to retard chambers 48 and vented from advance chambers 46 in order to cause relative rotation between stator 16 and rotor 18 which results in retarding the timing of camshaft 14 relative to the crankshaft of internal combustion engine 10. Advance oil passages 56 may be provided in rotor 18 for supplying and venting oil from advance chambers 46 while retard oil passages 58 may be provided in rotor 18 for supplying and venting oil from retard chamber 48. Supplying and venting of oil to and from advance chambers 46 and retard chambers 48 may be controlled by a multi-way oil control valve that may be located either within camshaft phaser 12 as is known in the art, for example as shown in United States Patent Application Publication No. US 2012/0255509 A1 to Lichti et al. which is incorporated herein by reference in its entirety. Alternatively, the multi-way oil control valve may be located external to camshaft phaser 12 as is known in the art, for example as shown in United States Patent Application Publication No. US 2010/0288215 A1 to Takemura et al. which is incorporated herein by reference in its entirety. In this way, rotor 18 rotates within stator 16 between a maximum advance position and a maximum retard position as determined by the space available for vanes 42 to move within radial chambers 34.

Bias spring 24 is disposed within an annular pocket 60 formed in rotor 18 and within a central bore 62 of front cover 22. Bias spring 24 is grounded at one end thereof to front cover 22 and is attached at the other end thereof to rotor 18. In this way, bias spring 24 either partially or completely offset the natural retarding torque induced by the overall valve train friction, to balance performance times, or to help return the phaser to a predetermined aligned position of rotor 18 within stator 16 which is between the full advance and full retard positions. When internal combustion engine 10 is shut down or if there is a malfunction of the multi-way valve that controls oil being supplied and vented to/from advance chambers 46 and retard chambers 48, bias spring 24 urges rotor 18 to a predetermined aligned position within stator 16 in a way that will be described in more detail in the subsequent paragraphs.

Primary lock pin 28 and secondary lock pin 30 define a staged dual lock pin system for selectively preventing relative rotation between stator 16 and rotor 18 at the predetermined aligned position which is between the full retard and full advance positions. Primary lock pin 28 is slidably disposed within a primary lock pin bore 64 formed in one of the plurality of vanes 42 of rotor 18. A primary lock pin seat 66 is formed in front cover 22 for selectively receiving primary lock pin 28 therewithin. Primary lock pin seat 66 is larger than primary lock pin 28 to allow rotor 18 to rotate relative to stator 16 about 5° on each side of the predetermined aligned position when primary lock pin 28 is seated within primary lock pin seat 66. The enlarged nature of primary lock pin seat 66 allows primary lock pin 28 to be easily received therewithin. When primary lock pin 28 is not desired to be seated within primary lock pin seat 66, pressurized oil is supplied to primary lock pin 28, thereby urging primary lock pin 28 out of primary lock pin seat 66 and compressing a primary lock pin spring 68. Conversely, when primary lock pin 28 is desired to be seated within primary lock pin seat 66, the pressurized oil is vented from primary lock pin 28, thereby allowing primary lock pin spring 68 to urge primary lock pin 28 toward front cover 22. In this way, primary lock pin 28 is seated within primary lock pin seat 66 by primary lock pin spring 68 when rotor 18 is positioned within stator 16 to allow alignment of primary lock pin 28 with primary lock pin seat 66.

Secondary lock pin 30 is slidably disposed within a secondary lock pin bore 72 formed in one of the plurality of vanes 42 of rotor 18. A secondary lock pin seat 74 is formed in front cover 22 for selectively receiving secondary lock pin 30 therewithin. Secondary lock pin 30 fits within secondary lock pin seat 74 in a close sliding relationship, thereby substantially preventing relative rotation between rotor 18 and stator 16 when secondary lock pin 30 is received within secondary lock pin seat 74. When secondary lock pin 30 is not desired to be seated within secondary lock pin seat 74, pressurized oil is supplied to secondary lock pin 30, thereby urging secondary lock pin 30 out of secondary lock pin seat 74 and compressing a secondary lock pin spring 76. Conversely, when secondary lock pin 30 is desired to be seated within secondary lock pin seat 74, the pressurized oil is vented from secondary lock pin 30, thereby allowing secondary lock pin spring 76 to urge secondary lock pin 30 toward front cover 22. In this way, secondary lock pin 30 is seated within secondary lock pin seat 74 by secondary lock pin spring 76 when rotor 18 is positioned within stator 16 to allow alignment of secondary lock pin 30 with secondary lock pin seat 74.

Further features and details of operation of primary lock pin 28 and secondary lock pin 30 are describe in U.S. Pat. No. 8,056,519 to Cuatt et al. which is incorporated herein by reference in its entirety.

A lock pin control valve spool 78 may control the supply and venting of pressurized oil to and from primary lock pin 28 and secondary lock pin 30. Lock pin control valve spool 78 may be slidably disposed within a valve bore 80 of camshaft phaser attachment bolt 32. Valve bore 80 is centered about axis A. Lock pin control valve spool 78 includes lands 82 and is axially displaced within valve bore 80 by an actuator 84 and a valve spring 86. Actuator 84 may be a solenoid actuator and may urge lock pin control valve spool 78 to a lock pin disengaged position by applying an electric current to actuator 84. Application of an electric current to actuator 84 causes lock pin control valve spool 78 to move toward the bottom of valve bore 80, thereby compressing valve spring 86 and positioning lands 82 to prevent oil from being vented from to primary lock pin 28 and secondary lock pin 30 while allowing pressurized oil to be supplied to primary lock pin 28 and secondary lock pin 30 from valve bore 80 which is supplied by internal combustion engine 10, for example, by a passage (not shown) in camshaft 14. Conversely, valve spring 86 may urge lock pin control valve spool 78 to a lock pin engaged position when no electric current is applied to actuator 84. When no electric current is applied to actuator 84, lock pin control valve spool 78 is moved away from the bottom of valve bore 80 by valve spring 86, thereby positioning lands 82 to prevent pressurized oil from being supplied to primary lock pin 28 and secondary lock pin 30 and to vent oil from primary lock pin 28 and secondary lock pin 30. While lock pin control valve spool 78 has been described as being located within camshaft phaser 12, it should be understood that a valve external to camshaft phaser 12 may alternatively be used as is known in the art, for example as shown in United States Patent Application Publication No. US 2012/0255509 A1 to Lichti et al. which is incorporated herein by reference in its entirety.

When it is desired to prevent relative rotation between rotor 18 and stator 16 at the predetermined aligned position, the pressurized oil is vented from both primary lock pin 28 and secondary lock pin 30, thereby allowing primary lock pin spring 68 and secondary lock pin spring 76 to urge primary lock pin 28 and secondary lock pin 30 respectively toward front cover 22. In order to align primary lock pin 28 and secondary lock pin 30 with primary lock pin seat 66 and secondary lock pin seat 74 respectively, rotor 18 may be rotated with respect to stator 16 by one or more of supplying pressurized oil to advance chambers 46, supplying pressurized oil to retard chambers 48, urging from bias spring 24, and torque from camshaft 14. Since primary lock pin seat 66 is enlarged, primary lock pin 28 will be seated within primary lock pin seat 66 before secondary lock pin 30 is seated within secondary lock pin seat 74. With primary lock pin 28 seated within primary lock pin seat 66, rotor 18 is allowed to rotate with respect to stator 16 by about 10°. Rotor 18 may be further rotated with respect to stator 16 by one or more of supplying pressurized oil to advance chambers 46, supplying pressurized oil to retard chambers 48, urging from bias spring 24, and torque from camshaft 14 in order to align secondary lock pin 30 with secondary lock pin seat 74, thereby allowing secondary lock pin 30 to be seated within secondary lock pin seat 74.

Bias spring 24 applies a torque to rotor 18 for the entire range of motion of rotor 18 within stator 16, i.e. between the full retard position and the full advance position including the full retard position and the full advance position, and in the direction toward the full advance position. Counterbalancing members 26, which are compliant and resilient, are provided to counteract or neutralize the torque of bias spring 24 from the predetermined aligned position to the full advance position, thereby easing the engagement of primary lock pin 28 with primary lock pin seat 66 and secondary lock pin 30 with secondary lock pin seat 74.

Figure 4:
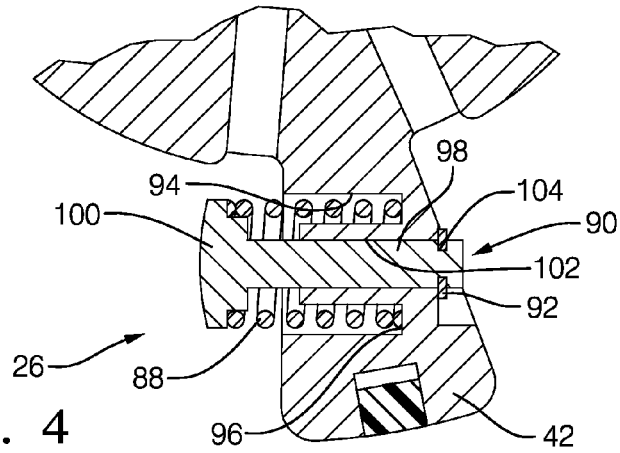
FIG. 4 is an enlarged view of a portion of FIG. 2 showing a counterbalancing member in accordance with the present invention.

In addition to FIGS. 1-3, reference will now be made to FIG. 4. Counterbalancing members 26 may be substantially identical; consequently, the subsequent description will describe counterbalancing members 26 in singular. Counterbalancing member 26 is attached to one of the plurality of vanes 42, which, as shown, may be the vane 42 which does not include either primary lock pin 28 or secondary lock pin 30. Counterbalancing member 26 reacts against the adjacent lobe 36 within retard chamber 48. Counterbalancing member 26 comprises a counterbalancing member spring 88, a plunger 90, and a plunger retainer 92 which will be described in the subsequent paragraphs.

Counterbalancing member spring 88 may be a coil compression spring which is received within a spring pocket 94 formed in vane 42. Spring pocket 94 is annular in shape and extends into a face of vane 42 that faces toward an adjacent lobe 36 of stator 16 such that spring pocket 94 extends into vane 42 in a direction that is substantially perpendicular to axis A. Spring pocket 94 does not extend through vane 42 and consequently defines a spring pocket bottom 96 upon which counterbalancing member spring 88 is grounded.

Plunger 90 includes a plunger stem 98 which may be substantially cylindrical and a plunger head 100 which may be substantially cylindrical and coaxial with plunger stem 98.

Plunger stem 98 is slidably received within a plunger bore 102 which extends through vane 42 in a coaxial relationship with spring pocket 94. Plunger stem 98 and plunger bore 102 are sized to provide a close sliding fit to substantially prevent leakage of oil therebetween while not substantially inhibiting the movement of plunger stem 98 in plunger bore 102. Plunger stem 98 may extend through vane 42 and protrude into the adjacent advance chamber 46. Plunger head 100 is sized to be larger in diameter than counterbalancing member spring 88 and is affixed to, or integrally formed with, the end of plunger stem 98 that is located within retard chamber 48, thereby defining a spring seat for counterbalancing member spring 88. Counterbalancing member spring 88 is held under compression between plunger head 100 and spring pocket bottom 96. Consequently, counterbalancing member spring 88 urges plunger 90 away from vane 42 toward the adjacent lobe 36 which defines retard chamber 48 within which counterbalancing member spring 88 is located.

Plunger retainer 92 may be a retaining ring that is received within a groove 104 formed annularly on the end of plunger stem 98 that is located within advance chamber 46. In this way, vane 42 is located between plunger head 100 and plunger retainer 92.

Figure 5:
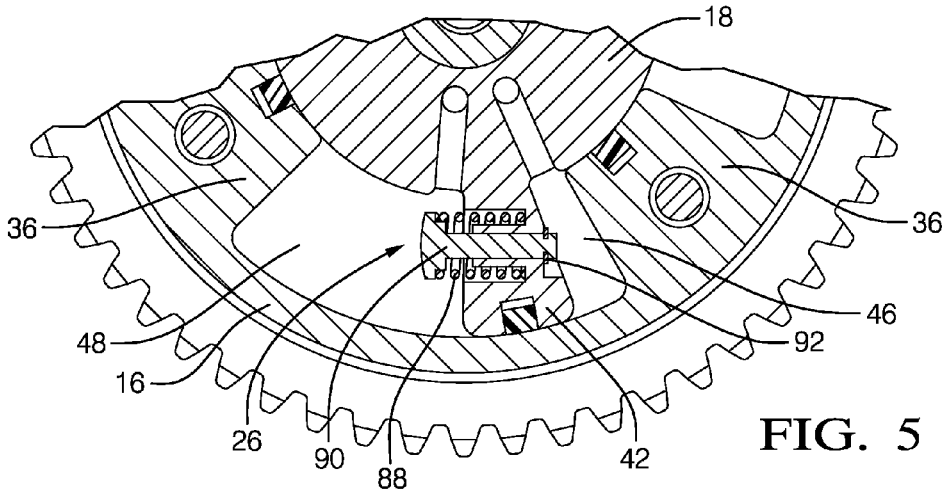
FIG. 5 is a radial cross-sectional view of a portion of the camshaft phaser in accordance with the present invention showing the camshaft phaser in a full retard position.

The operation of counterbalancing members 26 will now be described with reference to FIGS. 5-7. As shown in FIG. 5, rotor 18 is positioned within stator 16 at the full retard position. As can be seen, counterbalancing members 26 are in a free state and do not apply a torque between rotor 18 and stator 16. Also as shown in FIG. 5 counterbalancing member spring 88 has urged plunger 90 into retard chamber 48 until plunger retainer 92 abuts vane 42. Counterbalancing members 26 will remain in the free state up until rotor 18 is located in the predetermined aligned position within stator 16, i.e. secondary lock pin 30 (not shown in FIG. 5) is aligned with secondary lock pin seat 74 (not shown in FIG. 5).

Figure 6:
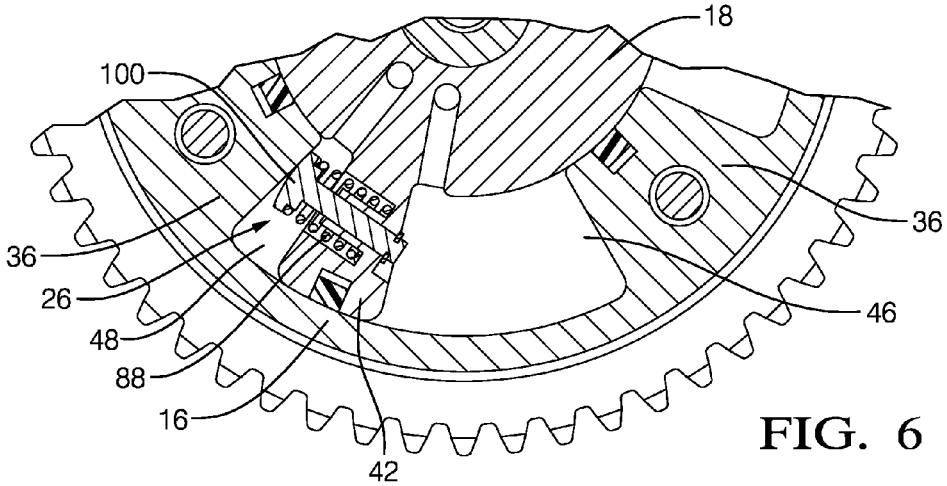
FIG. 6 is the radial cross-sectional view of FIG. 5 now showing the camshaft phaser in a predetermined aligned position that is between the full retard position and a full advance position.

Now referring to FIG. 6, rotor 18 is located in the predetermined aligned position within stator 16, i.e. secondary lock pin 30 (not shown in FIG. 6) is aligned with secondary lock pin seat 74 (not shown in FIG. 6). As can be seen, plunger heads 100 of counterbalancing members 26 have come into contact with the adjacent lobe 36 of stator 16, but counterbalancing member springs 88 have not yet been compressed further than when stator 16 is position from the full retard position to just before reaching the predetermined aligned position from the full retard position as shown in FIG. 5. The sum of spring forces of each counterbalancing member springs 88 are selected to essentially equal the force of bias spring 24 (not shown in FIG. 6). Consequently, when rotor 18 is located in the predetermined aligned position within stator 16, counterbalancing members 26 neutralize or offset the effects of bias spring 24, thereby preventing bias spring 24 from urging stator 16 past the predetermined aligned position toward the full advance position and easing the insertion of secondary lock pin 30 within secondary lock pin seat 74.

Figure 7:
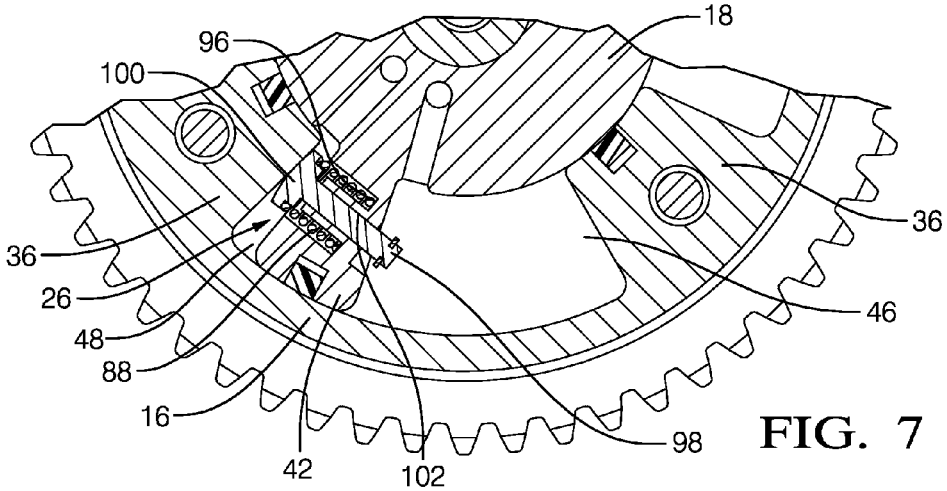
FIG. 7 is the radial cross-sectional view of FIGS. 5 and 6 now showing the camshaft phaser in the full advance position.

Now referring to FIG. 7, rotor 18 is located in the full advance position within stator 16. As can be seen, rotation of rotor 18 has caused counterbalancing member springs 88 to be compressed further between plunger head 100 and spring pocket bottom 96 and plunger stem 98 to slide within plunger bore 102. Consequently, counterbalancing members 26 neutralize or offset the effects of bias spring 24 for the entire motion of rotor 18 from the predetermined aligned position to the full advance position, thereby easing the insertion of secondary lock pin 30 within secondary lock pin seat 74.

Figure 8:
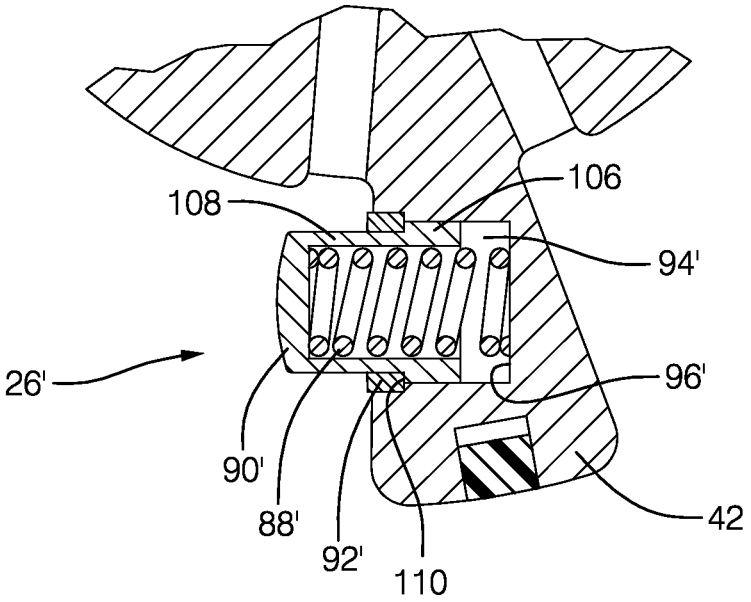
FIG. 8 is the enlarged view of FIG. 4 now showing an alternative counterbalancing member.

Reference will now be made to FIG. 8 which shows an alternative counterbalancing member 26'. Counterbalancing member 26' comprises a counterbalancing member spring 88', a plunger 90', and a plunger retainer 92' which will be described in the subsequent paragraphs.

Counterbalancing member spring 88' may be a coil compression spring which is received within a spring pocket 94' formed in vane 42. Spring pocket 94' is cylindrical in shape and extends into a face of vane 42 that faces toward an adjacent lobe 36 of stator 16 such that spring pocket 94' extends into vane 42 in a direction that is substantially perpendicular to axis A. Spring pocket 94' does not extend through vane 42 and consequently defines a spring pocket bottom 96' upon which counterbalancing member spring 88' is grounded.

Plunger 90' is substantially cylindrical and cup-shaped and includes a larger diameter section 106 at the open end of plunger 90', and a smaller diameter section 108 that extends from larger diameter section 106 to the closed end of plunger 90', thereby defining an annular shoulder 110 where lager diameter section 106 and smaller diameter section 108 meet and also defining a spring seat within plunger 90' for counterbalancing member spring 88'. Lager diameter section 106 is slidably received entirely within spring pocket 94' of vane 42 such that larger diameter section 106 is guided by spring pocket 94'. Counterbalancing member spring 88' is received within plunger 90' and held in compression between plunger 90' and spring pocket bottom 96'. Consequently, counterbalancing member spring 88' urges plunger 90' away from vane 42 toward the adjacent lobe 36 which defines retard chamber 48 within which counterbalancing member 26' is located.

Plunger retainer 92' may be substantially ring shaped and fixed within spring pocket 94', for example, by a press fit. Plunger retainer 92' has an inside diameter which is smaller than lager diameter section 106 of plunger 90'; consequently, the movement of plunger 90' is constrained between plunger retainer 92' and spring pocket bottom 96'.

In use, counterbalancing member 26' has substantially the same effect on bias spring 24 as counterbalancing member 26 described above.

While counterbalancing members 26 and counterbalancing members 26' have been illustrated as being attached to vane 42 to react with lobe 36, it should now be understood that this relationship may be reversed. More specifically, counterbalancing members 26 and counterbalancing members 26' may be attached lobe 36 to react with vane 42.

While counterbalancing member spring 88 and counterbalancing member spring 88' have been illustrated as compression coil springs, it should now be understood that springs of other forms may be used, for example only, leaf springs, torsional springs, wave springs, and elastomer springs. Furthermore, it should now be understood that some springs may be used alone without the need for plungers or plunger retainers etc.

While camshaft phaser 12 has been described as including bias spring 24, it should now be understood that bias spring 24 may be omitted. When bias spring 24 is omitted, the operation of counterbalancing members 26, 26' may be reversed from that as previously described. More specifically, counterbalancing members 26, 26' may be disposed within advance chamber 46. In this way, counterbalancing members 26, 26' do not apply a torque between rotor 18 and stator 16 when rotor 18 is between the predetermined aligned position and the full advance position, including the full advance position but excluding the predetermined aligned position. Also in this way, counterbalancing members 26, 26' apply a torque between rotor 18 and stator 16 when rotor 18 is between the predetermined aligned position and the full retard, including the full retard position and the predetermined aligned position. Consequently, counterbalancing members 26, 26' may overcome torque reversals from camshaft 14 and urge rotor 18 toward the predetermined aligned position.

While this invention has been described in terms of preferred embodiments thereof, it is not intended to be so limited, but rather only to the extent set forth in the claims that follow.

We claim:

1. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator, said rotor having a plurality of vanes interspersed with said lobes defining alternating advance chambers and retard chambers, wherein said advance chambers receive pressurized oil in order to change the phase relationship between said crankshaft and said camshaft in an advance direction and said retard chambers receive pressurized oil in order to change the phase relationship between said camshaft and said crankshaft in a retard direction, said rotor being rotatable within said stator from a full retard position to a full advance position and being attachable to said camshaft of said internal combustion engine to prevent relative rotation between said rotor and said camshaft;

a lock pin disposed within one of said rotor and said stator for selective engagement with a lock pin seat for preventing a change in phase relationship between said rotor and said stator at a predetermined aligned position between said full advance position and said full retard position when said lock pin is engaged with said lock pin seat;

a resilient counterbalancing member located within one of said advance chambers and said retard chambers, attached to one of said plurality of vanes or one of said plurality of lobes and compressible against an adjacent other of said plurality of vanes or lobes to thereby apply a torque between said rotor and said stator only when said rotor is between said predetermined aligned position and one of said full retard position and said full advance position.

2. A camshaft phaser as in claim 1 further comprising a bias spring for biasing said rotor toward said full advance position wherein said counterbalancing member substantially neutralizes said bias spring only between said predetermined aligned position and said full advance position.

3. A camshaft phaser as in claim 2 wherein said counterbalancing member comprises a spring.

4. A camshaft phaser as in claim 3 wherein said counterbalancing member further comprises a plunger.

5. A camshaft phaser as in claim 4 wherein said spring urges said plunger away from said one of said plurality of vanes or one of said plurality of lobes.

6. A camshaft phaser as in claim 4 wherein said plunger comprises:

a plunger stem that slides within a plunger bore extending into said one of said plurality of vanes or one of said plurality of lobes; and a plunger head affixed to said plunger stem and defining a spring seat for said spring.

7. A camshaft phaser as in claim 6 wherein said spring is a coil compression spring which is coaxial with said plunger stem.

8. A camshaft phaser as in claim 7 wherein said spring radially surrounds said plunger stem.

9. A camshaft phaser as in claim 8 wherein said spring is received within a spring pocket formed in said one of said plurality of vanes or one of said plurality of lobes and said plunger stem extends through said plunger bore such that said spring pocket radially surrounds said plunger bore.

10. A camshaft phaser as in claim 6 wherein said plunger bore extends through said one of said plurality of vanes or one of said plurality of lobes and said plunger stem extends through said plunger bore.

11. A camshaft phaser as in claim 10 wherein said plunger further comprises a plunger retainer on said plunger stem such that said one of said plurality of vanes or one of said plurality of lobes is located between said plunger head and said plunger retainer.

12. A camshaft phaser as in claim 4 wherein said plunger is cup-shaped and said spring is located within said plunger.

13. A camshaft phaser as in claim 2 wherein said counterbalancing member is one of a plurality of counterbalancing members.

14. A camshaft phaser as in claim 2 wherein said counterbalancing member is located within one of said retard chambers.

15. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator, said rotor having a plurality of vanes interspersed with said lobes defining alternating advance chambers and retard chambers, wherein said advance chambers receive pressurized oil in order to change the phase relationship between said crankshaft and said camshaft in an advance direction and said retard chambers receive pressurized oil in order to change the phase relationship between said camshaft and said crankshaft in a retard direction, said rotor being rotatable within said stator from a full retard position to a full advance position and being attachable to said camshaft of said internal combustion engine to prevent relative rotation between said rotor and said camshaft;

a lock pin disposed within one of said rotor and said stator for selective engagement with a lock pin seat for preventing a change in phase relationship between said rotor and said stator at a predetermined aligned position between said full advance position and said full retard position when said lock pin is engaged with said lock pin seat;

a bias spring for biasing said rotor toward said full advance position;

a resilient counterbalancing member located within one of said advance chambers and said retard chambers, attached to one of said plurality of vanes or one of said plurality of lobes and compressible against an adjacent other of said plurality of vanes or lobes to apply a torque between said rotor and said stator only when said rotor is between said predetermined aligned position and one of said full retard position and said full advance position, thereby substantially neutralizing said bias spring only between said predetermined aligned position and said full advance position.

* * * * *